US007988244B2

(12) United States Patent
Haws, Jr.

(10) Patent No.: US 7,988,244 B2
(45) Date of Patent: Aug. 2, 2011

(54) MODULAR MERCHANDISE POD

(76) Inventor: Joe D. Haws, Jr., Shreveport, LA (US)

( * ) Notice: Subject to any disclaimer, the term of this patent is extended or adjusted under 35 U.S.C. 154(b) by 670 days.

(21) Appl. No.: 12/009,321

(22) Filed: Jan. 17, 2008

(65) Prior Publication Data

US 2009/0184610 A1 Jul. 23, 2009

(51) Int. Cl.
*A47B 87/00* (2006.01)

(52) U.S. Cl. ..... 312/108; 312/198; 312/140.1; 312/257.1; 312/265.1

(58) Field of Classification Search ..... 312/107, 312/108, 111, 198, 140.2, 140.1, 257.1, 263, 312/265.1–265.4
See application file for complete search history.

(56) References Cited

U.S. PATENT DOCUMENTS

| | | | | |
|---|---|---|---|---|
| 3,169,810 | A * | 2/1965 | Levy et al. | 312/140.1 |
| 3,552,817 | A * | 1/1971 | Marcolongo | 312/107 |
| 4,789,048 | A * | 12/1988 | Cramer et al. | 186/61 |
| 5,147,120 | A * | 9/1992 | Ray | 312/111 |
| 5,943,828 | A * | 8/1999 | Samborn et al. | 52/36.1 |
| 6,027,188 | A * | 2/2000 | Nickens | 312/111 |
| 6,286,758 | B1 * | 9/2001 | Dejaeger et al. | 235/383 |
| 6,834,596 | B2 * | 12/2004 | Kerber | 108/42 |
| 7,497,531 | B2 * | 3/2009 | Gross | 312/107 |
| 2002/0020585 | A1 * | 2/2002 | Cernik et al. | 186/68 |
| 2007/0012640 | A1 * | 1/2007 | Scholen et al. | 211/195 |
| 2008/0303386 | A1 * | 12/2008 | Ackerman et al. | 312/140.1 |
| 2009/0184609 | A1 * | 7/2009 | Haws, Jr. | 312/117 |

* cited by examiner

*Primary Examiner* — Janet M Wilkens
*Assistant Examiner* — Dan Rohrhoff
(74) *Attorney, Agent, or Firm* — R. Keith Harrison

(57) ABSTRACT

A modular merchandise pod includes a generally elongated merchandise pod base having first and second ends, a rack assembly carried by the merchandise pod base and disposed generally midway between the first and second ends and a rack assembly top panel carried by the rack assembly.

14 Claims, 6 Drawing Sheets

MODULAR MERCHANDISE POD

FIELD

The present disclosure relates to merchandise storage, display and dispensing systems and the like. More particularly, the present disclosure relates to a modular merchandise pod which can be expeditiously assembled on-site and facilitates the storage, display and/or dispensing of merchandise and the like.

BACKGROUND

Merchandise storage, display and dispensing systems are commonly used in retail outlets to store, display and/or dispense various types of merchandise. Such systems vary considerably in design and may range from relatively simple shelves on which the merchandise is supported to elaborate metal assemblies having multiple arms from which the merchandise is suspended. Some systems may include additional features for supporting checkout equipment and/or other items which are used by sales personnel.

Systems having complex structures may require considerable time and labor to assemble. This may contribute to time and expense in preparing a new retail outlet for use, particularly under circumstances in which the structures must be repeatedly duplicated in chain retail outlets, for example. Under such circumstances, product storage, display and dispensing systems which are amenable to expeditious assembly and installation would be advantageous.

SUMMARY

The present disclosure is generally directed to a modular merchandise pod. An illustrative embodiment of the modular merchandise pod includes a generally elongated merchandise pod base having first and second ends, a rack assembly carried by the merchandise pod base and disposed generally midway between the first and second ends and a rack assembly top panel carried by the rack assembly.

BRIEF DESCRIPTION OF THE DRAWINGS

The disclosure will now be made, by way of example, with reference to the accompanying drawings, in which.

DETAILED DESCRIPTION

Figure 1:
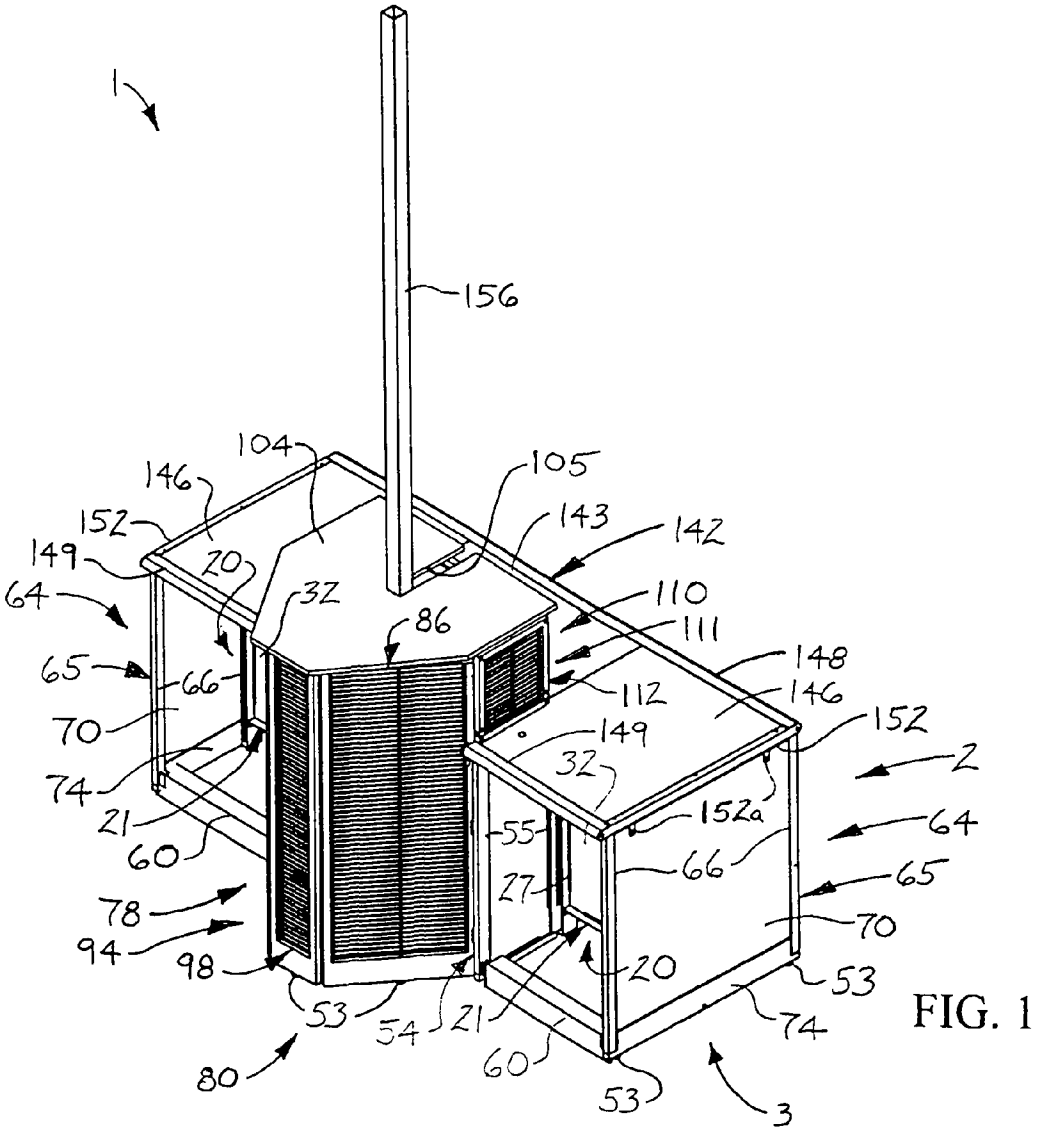
FIG. 1 is a front perspective view of an illustrative embodiment of the modular merchandise pod.
Figure 2:
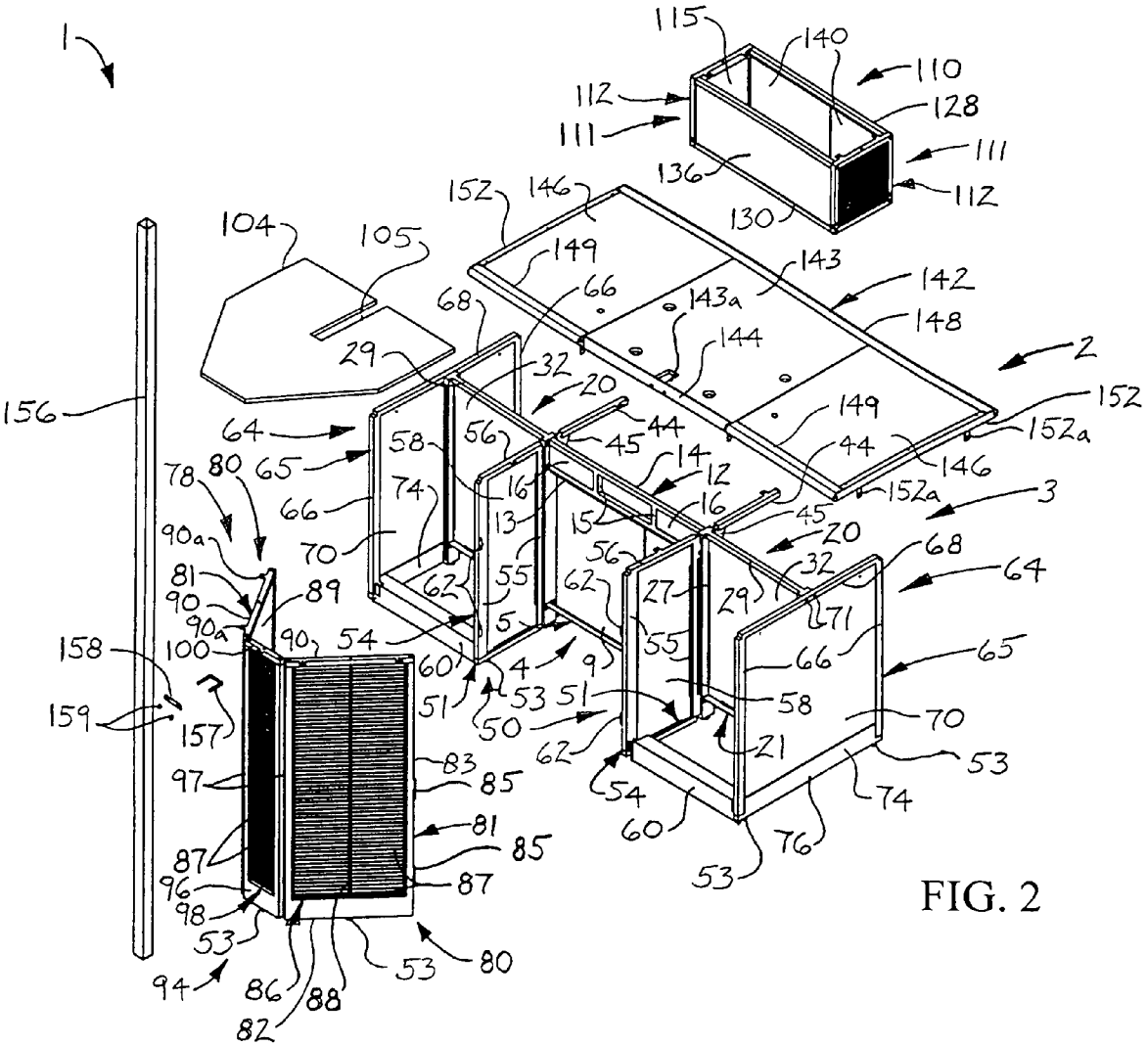
FIG. 2 is an exploded front perspective view of an illustrative embodiment of the modular merchandise pod.

Referring initially to FIGS. 1 and 2 of the drawings, an illustrative embodiment of the modular merchandise pod is generally indicated by reference numeral 1. The modular merchandise pod 1 includes a merchandise pod base 2 which may have a generally elongated, rectangular, box-shaped configuration. As illustrated in FIG. 2, the merchandise pod base 2 may include a base frame 3 and a table top assembly 142 which is provided on the base frame 3. A rack assembly 78 may be provided at generally the front center of the merchandise pod base 2. A box top assembly 110 may be provided on the merchandise pod base 2, generally behind or adjacent to the rack assembly 78. A rack assembly top panel 104 may be provided on the rack assembly 78 and the box top assembly 110, in an elevated configuration with respect to the table top assembly 142. Accordingly, as will be hereinafter described, merchandise (not illustrated) such as automobile parts, for example, may be stored in the merchandise pod base 2. Additional merchandise may be supported by or suspended from merchandise-supporting brackets (not illustrated) which are attached to the rack assembly 78, typically in the conventional manner. Checkout or sales equipment (not illustrated) such as cash registers, for example, may be placed on the table top assembly 142 at either or both ends of the merchandise pod base 2.

Figures 3, 4:
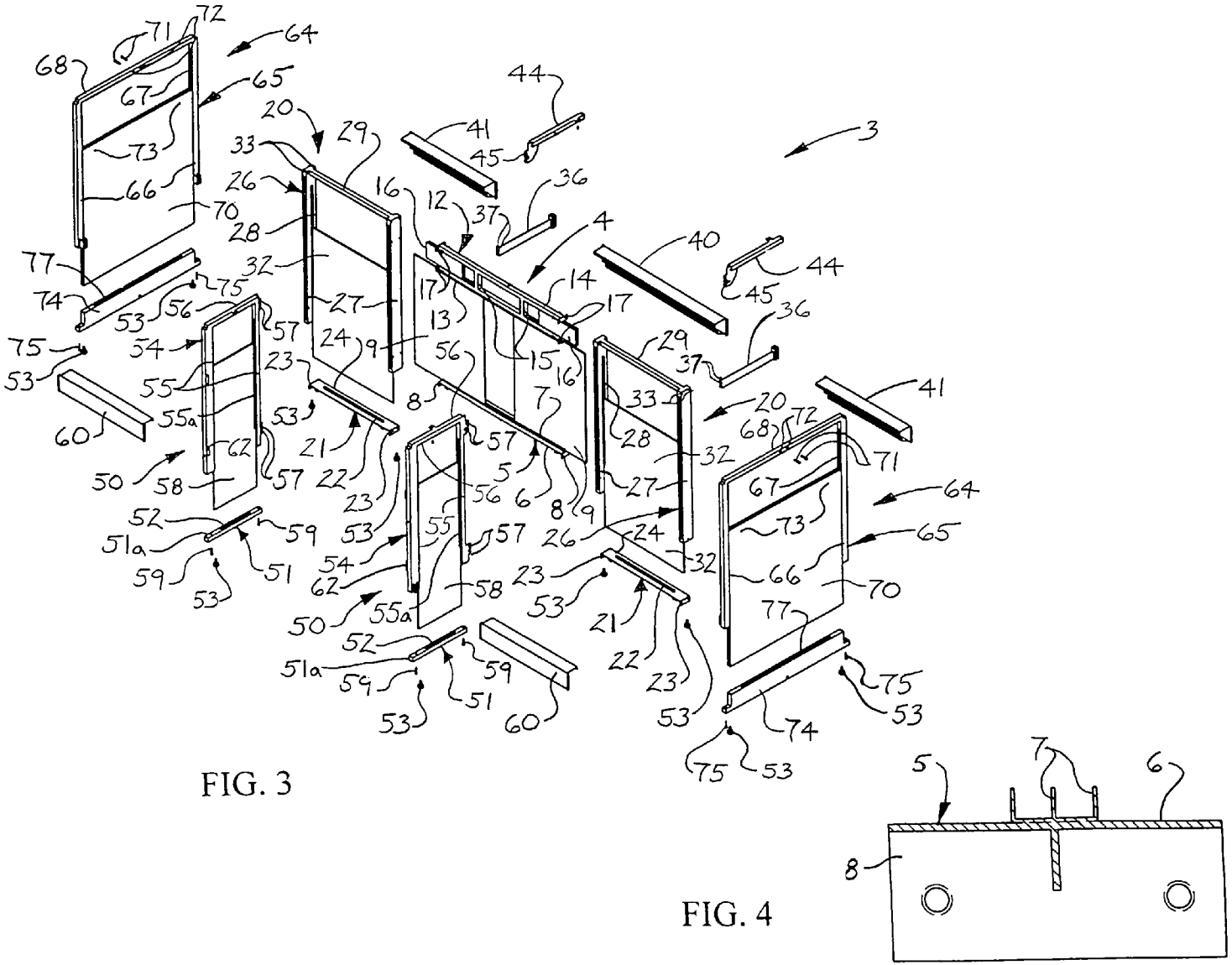
FIG. 3 is an exploded front perspective view of a base frame portion of a merchandise pod base component of an illustrative embodiment of the modular merchandise pod.
FIG. 4 is a cross-sectional view of a bottom frame rail element of the base frame portion.

Referring next to FIGS. 2-5 of the drawings, the base frame 3 of the merchandise pod base 2 may include a center frame assembly 4 which may have a generally elongated, rectangular configuration. As illustrated in FIG. 3, the center frame assembly 4 includes a bottom frame rail 5 having a generally elongated frame rail plate 6. A frame rail flange 8 may extend downwardly from the frame rail plate 6 at each end thereof.

The center frame assembly 4 further includes a top frame rail 12 which is disposed in generally spaced-apart, parallel relationship with respect to the bottom frame rail 5. The top frame rail 12 may include a generally elongated bottom rail segment 13; a generally elongated top rail segment 14 oriented in generally parallel, spaced-apart relationship with respect to the bottom rail segment 13; and a pair of spaced-apart connecting rail segments 15 which extend between and connect the bottom rail segment 13 and the top rail segment 14. A pair of top frame rail insert panels 16 may be slidably mounted between the bottom rail segment 13 and the top rail segment 14 at respective ends of the top frame rail 12. As illustrated in FIG. 3, top frame rail flanges 17 may terminate respective ends of each of the bottom rail segment 13 and the top rail segment 14 of the top frame rail 12 for purposes which will be hereinafter described.

A pair of sliding doors 9 may be slidably mounted between the bottom frame rail 5 and the top frame rail 12 according to the knowledge of those skilled in the art. As illustrated in the cross-sectional view of FIG. 4, in some embodiments, a pair of generally elongated, adjacent frame rail channels 7 extends along an upper surface of the frame rail plate 6 of the bottom frame rail 5. The frame rail channels 7 may be generally coextensive with the length of the frame rail plate 6. Accordingly, the lower edge of each sliding door 9 may be inserted in a corresponding one of the adjacent frame rail channels 7 of the bottom frame rail 5. The upper edge of each sliding door 9 may be inserted in a similar channel (not illustrated) which extends along the lower surface of the bottom rail segment 13 of the top frame rail 12.

The base frame 3 of the merchandise pod base 2 may further include a pair of side frame assemblies 20 which interface with respective ends of the center frame assembly 4, as illustrated in FIG. 2, typically in a manner which will be hereinafter described. As illustrated in FIG. 3, each side frame assembly 20 includes a bottom frame rail 21 having a generally elongated frame rail plate 24. A pair of frame rail flanges 23 may extend from the respective ends of the frame rail plate 24.

Figure 5:
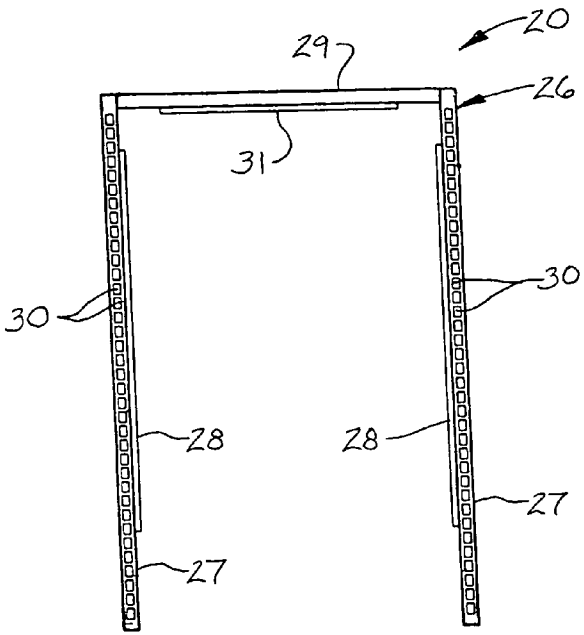
FIG. 5 is a front view of a side frame assembly portion of the base frame.

Each side frame assembly 20 of the base frame 3 further includes a side frame 26 which may have a generally inverted U-shaped configuration. As illustrated in FIG. 5, each side frame 26 may include a pair of generally elongated, parallel, spaced-apart side frame segments 27 and a generally elongated connecting frame segment 29 which connects the side frame segments 27. Each of the side frame segments 27 may be oriented in generally perpendicular relationship with respect to the connecting frame segment 29. As illustrated in FIG. 5, multiple slots 30 may be provided in each side frame segment 27 for purposes which will be hereinafter described.

As illustrated in FIG. 3, a generally elongated and rectangular side frame assembly insert panel 32 may be slidably mounted between the side frame segments 27 of the side frame 26 according to the knowledge of those skilled in the art. In some embodiments, for example, side channels 28 may extend along the respective side frame segments 27 in facing relationship with respect to each other, as illustrated in FIG. 5. The side edges of the side frame assembly insert panel 32 may be slidably inserted in the respective side channels 28. As further illustrated in FIG. 5, a top channel 31 may be provided on the connecting segment 29 to receive an upper edge of the side frame assembly insert panel 32 when the side frame assembly insert panel 32 is inserted in the side channels 28 of the respective side frame segments 27. A frame rail channel 22 may extend along an upper surface of the frame rail plate 24 to receive a bottom edge of the side frame assembly insert panel 32. A pair of frame support feet 53 may be attached to the bottom frame rail 21 of each side frame assembly 20 to support the side frame assemblies 20 on a supporting surface (not illustrated). Each bottom frame rail 21 may be attached to the side frame 26 of the corresponding side frame assembly 20 using threaded fasteners (not illustrated) and/or other suitable fastening technique.

The base frame 3 of the merchandise pod base 2 may further include a pair of front frame assemblies 50 which interface with the respective side frame assemblies 20 typically in a manner which will be hereinafter described. As illustrated in FIG. 3, each front frame assembly 50 includes a bottom frame rail 51 having a generally elongated frame rail body 51*a*. A front frame 54 of each front frame assembly 50 may have a generally inverted U-shape, including a pair of generally elongated, parallel, spaced-apart side frame segments 55 which are attached to the bottom frame rail 51, typically in a manner which will be hereinafter described, and a generally elongated connecting frame segment 56 which connects the side frame segments 55. Front frame flanges 57 may extend from one of the side frame segment 55 of the front frame 54 for purposes which will be hereinafter described.

A generally elongated, rectangular front frame insert panel 58 may be slidably mounted between the side frame segments 55 of the front frame 54. As illustrated in FIG. 3, rail channels 55*a* (one of which is shown) may extend along the respective side frame segments 55 in facing relationship with respect to each other to receive respective side edges of the front frame insert panel 58. A frame rail channel 52 may extend along an upper surface of the frame rail body 51*a* of the bottom frame rail 51 to receive a lower edge of the front frame insert panel 58. The bottom frame rail 51 may be fastened to the front frame 54 of each front frame assembly 50 using any suitable technique which is known by those skilled in the art. For example, in some embodiments fasteners 59 may be extended through respective fastener openings (not labeled) provided in the frame rail body 51*a* and threaded into respective registering fastener openings (not illustrated) provided in the respective side frame segments 55 of the front frame 54. A frame support foot 53 may be attached to the bottom frame rail 51 of each front frame assembly 50 to support the front frame assemblies 50 on a supporting surface (not illustrated).

The base frame 3 of the merchandise pod base 2 may further include a pair of end frame assemblies 64 which interface with the respective side frame assemblies 20 typically in a manner which will be hereinafter described. Each end frame assembly 64 includes an end frame 65 which may have a generally inverted U-shaped configuration. The end frame 65 may have a pair of generally elongated, parallel, spaced-apart side frame segments 66 and a generally elongated connecting frame segment 68 which extends between and connects the side frame segments 66.

A generally elongated, rectangular end frame insert panel 70 may be slidably mounted between the side frame segments 66 of the end frame 65 according to the knowledge of those skilled in the art. As illustrated in FIG. 3, in some embodiments, side channels 67 (one of which is illustrated) extend along the respective side frame segments 66 in facing relationship with respect to each other and receive the respective side edges of the end frame insert panel 70. A generally elongated end frame bottom 74 is fastened to the end frame 65 such as by, for example, extending fasteners 75 through fastener openings (not numbered) provided in the end frame bottom 74 and threading the fasteners 75 into respective registering fastener openings (not illustrated) provided in the respective side frame segments 66 of the end frame 65. An end frame bottom channel 77 may extend along the end frame bottom 74 to receive a bottom edge of the end frame insert panel 70. A frame support foot 53 may be attached to the end frame bottom 74 of each end frame assembly 64 to support the end frame assemblies 64 on a supporting surface (not illustrated).

The base frame 3 of the merchandise pod base 2 may be assembled by initially assembling the center frame assembly 4, each side frame assembly 20, each front frame assembly 50 and each end frame assembly 64 typically as was heretofore described. Each side frame assembly 20 may be attached to the top frame rail 12 by, for example, extending fasteners (not illustrated) through fastener openings (not numbered) provided in the side frame 26 of each side frame assembly 20 and into registering fastener openings (not illustrated) provided in each corresponding top frame rail flange 17 on the top frame rail 12. Each end frame assembly 64 may be attached to the corresponding side frame assembly 20 by, for example, extending end frame fasteners 71 through respective fastener openings 72 provided in the corresponding end frame 65 and threading the end frame fasteners 71 through respective registering fastener openings 33 provided in the side frame 26 of the corresponding side frame assembly 20. Each front frame assembly 50 may be attached to the corresponding side frame assembly 20 by, for example, inserting the front frame flanges 57 on the front frame 54 of each front frame assembly 50 into respective slots 30 (FIG. 5) provided in one of the side frame segments 27 on the side frame 26 of each side frame assembly 20.

As further illustrated in FIGS. 2 and 3, a front kick plate 60 may be attached to each front frame assembly 50 and the adjacent end frame assembly 64 on each corresponding end of the base frame 3 using threaded fasteners (not illustrated) and/or any suitable alternative technique. As illustrated in FIG. 3, a generally elongated kick plate bracket 36 may be attached to a side frame segment 27 on the side frame 26 of each side frame assembly 20 such as, for example, by inserting bracket flanges 37 provided on the kick plate bracket 36 into slots 30 (FIG. 5) provided in a side frame segment 27 of the side frame 26. A center kick plate 40 may be attached to and extend between the kick plate brackets 36 using fasteners (not illustrated) and/or suitable alternative techniques known by those skilled in the art. A side kick plate 41 may additionally be attached to the kick plate brackets 36 on each side of the center kick plate 40 according to the knowledge of those skilled in the art. As further illustrated in FIG. 3, an outrigger 44 may be attached to a side frame segment 27 on the side frame 26 of each side frame assembly 20 such as by, for example, inserting outrigger flanges 45 provided on the outrigger 44 into slots 30 (FIG. 5) provided in the side frame segment 27 of the side frame 26.

Figure 8:
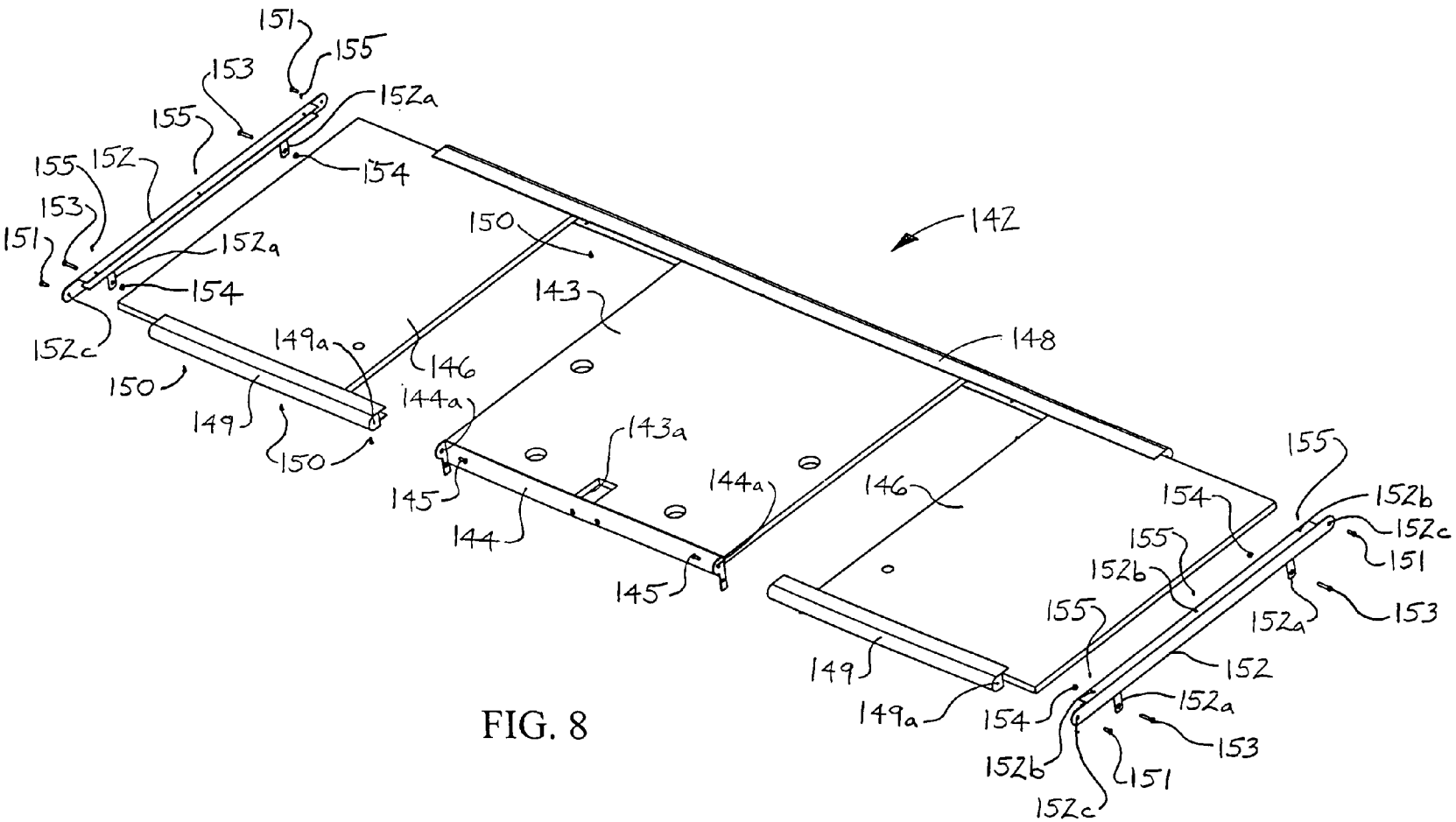
FIG. 8 is an exploded perspective view of a table top assembly portion of the merchandise pod base component of an illustrative embodiment of the modular merchandise pod.

Referring next to FIGS. 1, 2 and 8 of the drawings, the table top assembly 142 is provided on the base frame 3 of the merchandise pod base 2. As illustrated in FIG. 8, the table top assembly 142 may include a generally square or rectangular center tabletop panel 143. A generally elongated stabilizer bar 144 may extend along a front edge of the center tabletop panel 143. A power pole opening 143*a* may extend through the center tabletop panel 143 for purposes which will be hereinafter described. A generally square or rectangular side tabletop panel 146 is provided on each side of the center tabletop panel 143. A generally elongated, channel-shaped rear frame rail 148 receives the rear edges of the center tabletop panel 143 and each of the side tabletop panels 146 to secure the center tabletop panel 143 and the side tabletop panels 146 in the table top assembly 142. A channel-shaped front frame rail segment 149 receives the front edge of each of the side tabletop panels 146. Fasteners 150 may be extended through respective fastener openings (not illustrated) provided in the front frame rail segment 149 and threaded into respective registering fastener openings (not illustrated) provided in the corresponding side tabletop panel 146 to secure each front frame rail segment 149 to the corresponding side tabletop panel 146. Each front frame rail segment 149 may be attached to the stabilizer bar 144 on the center tabletop panel 143 by, for example, extending a fastener 145 through a bracket opening 144*a* provided in the stabilizer bar 144 and threading the fastener 145 into a registering fastener opening 149*a* provided in the front frame rail segment 149.

A generally elongated end cap rail 152 may extend along the lateral or outside edge of each side tabletop panel 146 of the table top assembly 142. Each end cap rail 152 may be attached to the corresponding side tabletop panel 146 by, for example, extending fasteners 155 through respective fastener openings 152*b* provided in the end cap rail 152 and threading the fasteners 155 through respective registering fastener openings (not illustrated) provided in the corresponding side tabletop panel 146. Each end cap rail 152 may additionally be attached to a corresponding front frame rail segment 149 and the rear frame rail 148 by, for example, extending a fastener 151 through a fastener opening 152*c* provided in the end cap rail 152 and threading the fastener 151 into a fastener opening 149*a* provided in the front frame rail segment 149 and a fastener opening (not illustrated) provided in the rear frame rail 148, respectively.

The table top assembly 142 may be attached to the base frame 3 of the merchandise pod base 2 using any suitable technique which is known by those skilled in the art. As illustrated in FIGS. 2 and 8, rail flanges 152*a* may extend from each end cap rail 152. A fastener 153 (FIG. 8) may be extended through a flange opening (not numbered) provided in each rail flange 152*a* and threaded into a registering fastener opening 73 (FIG. 3) provided in the end frame insert panel 70 of each corresponding end frame assembly 64. A securing nut 154 (FIG. 8) may be threaded and tightened on each fastener 153.

Figure 6:
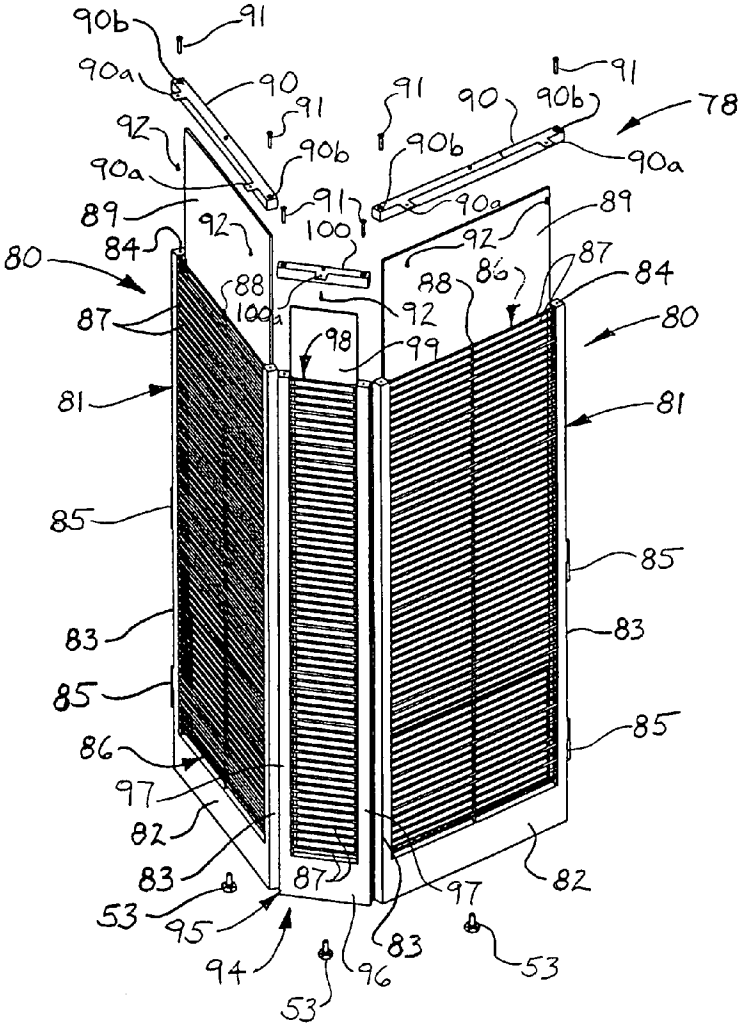
FIG. 6 is an exploded perspective view of a rack assembly component of an illustrative embodiment of the modular merchandise pod.

Referring next to FIGS. 1, 2 and 6 of the drawings the rack assembly 78 of the modular merchandise pod 1 may include a pair of outer panel assemblies 80 and a center panel assembly 94 which is disposed between the outer panel assemblies 80. Each outer panel assembly 80 and the center panel assembly 94 may have a generally elongated, rectangular configuration. The plane of each outer panel assembly 80 may be oriented at an obtuse angle with respect to the plane of the center panel assembly 94.

As illustrated in FIG. 6, each outer panel assembly 80 includes an outer panel assembly frame 81 which may have a generally elongated U-shaped configuration. The outer panel assembly frame 81 may include a generally elongated bottom frame segment 82 and a pair of generally elongated, parallel, spaced-apart side frame segments 83 which extend from the bottom frame segment 82. An outer hanging rack 86 is mounted in the outer panel assembly frame 81 of each outer panel assembly 80. The outer hanging rack 86 may include, for example, multiple rack rods 87 which extend between the side frame segments 83 of the outer panel assembly frame 81 in generally parallel, spaced-apart relationship with respect to each other. A reinforcing rod 88 may extend in generally perpendicular relationship with respect to the rack rods 87 for reinforcing purposes. An outer panel 89, which may have a generally elongated, rectangular configuration, may be slidably mounted between the side frame segments 83 of the outer panel assembly frame 81 adjacent to the outer hanging rack 86.

A generally elongated outer panel bracket 90 may be attached to the side frame segments 83 of the outer panel assembly frame 81 using any suitable technique which is known by those skilled in the art. In some embodiments, panel bracket fasteners 91 are extended through respective fastener openings 90*b* provided in the outer panel bracket 90 and threaded into respective fastener openings 84 provided in the respective side frame segments 83. A pair of bracket flanges 90*a* may extend from the outer panel bracket 90 for purposes which will be hereinafter described.

As further illustrated in FIG. 6, the center panel assembly 94 of the rack assembly 78 includes a center panel assembly frame 95 which may have a generally elongated U-shaped configuration. The center panel assembly frame 95 may include a bottom frame segment 96 and a pair of generally elongated, parallel, spaced-apart side frame segments 97 which extend from the bottom frame segment 96. A side frame segment 83 of each outer panel assembly frame 81 may be attached to a corresponding side frame segment 97 of the center panel assembly frame 95 using any suitable technique which is known by those skilled in the art.

A center hanging rack 98 is mounted in the center panel assembly frame 95 of the center panel assembly 94. The center hanging rack 98 may include, for example, multiple rack rods 87 which extend between the side frame segments 97 of the center panel assembly frame 95 in generally parallel, spaced-apart relationship with respect to each other. A center panel 99, which may have a generally elongated, rectangular configuration, may be slidably mounted between the side frame segments 97 of the center panel assembly frame 95 adjacent to the center hanging rack 98.

A generally elongated center panel bracket 100 may be attached to the side frame segments 97 of the center panel assembly frame 95 using any suitable technique which is known by those skilled in the art. In some embodiments, panel bracket fasteners 91 are extended through respective fastener openings (not numbered) provided in the center panel bracket 100 and threaded into respective fastener openings (not numbered) provided in the respective side frame segments 97. A bracket flange 100*a* may extend from the center panel bracket 100 for purposes which will be hereinafter described. Multiple frame support feet 53 may be attached to the bottom of the outer panel assembly frame 81 and the center panel assembly frame 95 to support the rack assembly 78 on a supporting surface (not illustrated).

The rack assembly 78 may be attached to the merchandise pod base 2 using any suitable technique which is known by those skilled in the art. As illustrated in FIGS. 2 and 3, in some embodiments at least one attachment pin receptacle 62 is provided on the front frame 54 of each front frame assembly 50 of the merchandise pod base 2. As illustrated in FIGS. 2 and 6, at least one attachment pin 85 is provided on the outer panel assembly frame 81 of each outer panel assembly 80 of the rack assembly 78. Each attachment pin 85 on the rack assembly 78 is inserted in the corresponding attachment pin receptacle 62 on the corresponding front frame assembly 50. Accordingly, as illustrated in FIG. 1, the rack assembly 78 is disposed generally midway between the respective ends of the merchandise pod base 2 and may be positioned between the front frame rail segments 149 of the table top assembly 142.

Figure 7:
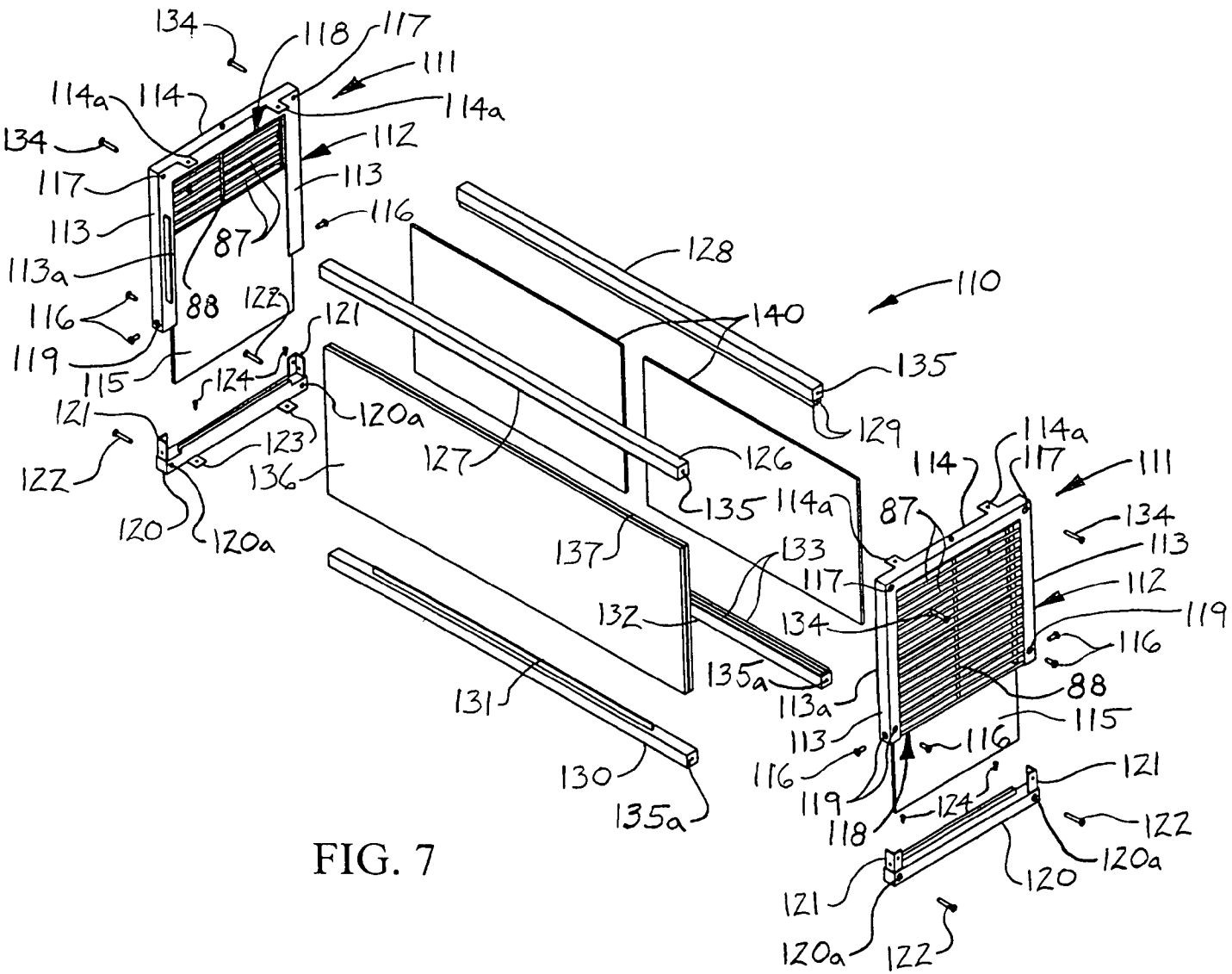
FIG. 7 is an exploded perspective view of a box top assembly component of an illustrative embodiment of the modular merchandise pod.

Referring next to FIGS. 2 and 7 of the drawings, the box top assembly 110 of the modular merchandise pod 1 includes a pair of spaced-apart box top end frame assemblies 111. Each box top end frame assembly 111 includes a box top end frame 112 which may have a generally inverted U-shaped configuration. As illustrated in FIG. 7, each box top end frame 112 may include a pair of generally elongated, parallel, spaced-apart side frame segments 113 and a generally elongated connecting frame segment 114 which extends between and connects the side frame segments 113. A pair of spaced-apart connecting frame segment flanges 114*a* may extend from the connecting frame segment 114 for purposes which will be hereinafter described. A generally square or rectangular end frame insert panel 115 may be slidably mounted between the side frame segments 113 of the box top end frame 112.

An end frame hanging rack 118 may be mounted between the side frame segments 113 of the box top end frame 112, adjacent to the corresponding end frame insert panel 115. With respect to the interior of the box top assembly 110, the end frame hanging rack 118 is typically disposed to the outside of the end frame insert panel 115. The end frame hanging rack 118 may include multiple, parallel, spaced-apart rack rods 87 which extend between the side frame segments 113 of the box top end frame 112. A reinforcing rod 88 may extend in generally perpendicular relationship with respect to the rack rods 87 for reinforcing purposes.

A generally elongated end frame bottom 120 may be attached to the side frame segments 113 of the box top end frame 112. A pair of spaced-apart end frame bottom flanges 121 may extend from the end frame bottom 120 to facilitate fastening of the end frame bottom 120 to the box top end frame 112. A pair of spaced-apart end frame bottom flanges 123 may extend from the end frame bottom 120 for purposes which will be hereinafter described. The end frame bottom 120 may be attached to the box top end frame 112 using any suitable technique which is known by those skilled in the art. In some embodiments, fasteners 116 may be extended through fastener openings 119 provided in the box top end frame 112 and through registering fastener openings (not numbered) provided in each end frame bottom flange 121 of the end frame bottom 120.

As further illustrated in FIG. 7, a top front frame rail 126; a top rear frame rail 128; a bottom front frame rail 130; and a bottom rear frame rail 132 extend between the box top end frame assemblies 111. The box top end frame 112 of each box top end frame assembly 111 may be attached to each of the top front frame rail 126 and the top rear frame rail 128 using any suitable technique which is known by those skilled in the art. In some embodiments, an end frame fastener 134 is extended through a fastener opening 117 provided in the box top end frame 112 and threaded into a registering fastener opening 135 provided in a corresponding end of the top front frame rail 126 and the top rear frame rail 128, respectively. In like manner, an end frame fastener 122 may be extended through a fastener opening 120*a* provided in the end frame bottom 120 and threaded into a registering fastener opening 135*a* provided in a corresponding end of the bottom front frame rail 130 and the bottom rear frame rail 132, respectively.

A frame panel 136, which may have a generally elongated, rectangular configuration, extends between the box top end frame assemblies 111 and between the top front frame rail 126 and the bottom front frame rail 130. In some embodiments, a blade slot 137 may be provided in the edge of the frame panel 136. A generally elongated rail blade 127 may extend from the top front frame rail 126, and a generally elongated rail blade 131 may extend from the bottom front frame rail 130. The rail blade 127 of the top front frame rail 126 and the rail blade 131 of the bottom front frame rail 130 are inserted into the blade slot 137 at respective sides of the frame panel 136. A rail blade 113*a* may extend from the box top end frame 112 of each box top end frame assembly 111 for insertion into the blade slot 137 at respective ends of the frame panel 136.

A pair of overlapping sliding doors 140 may be slidably mounted between the top rear frame rail 128 and the bottom rear frame rail 132 of the box top assembly 110 according to any suitable technique which is known by those skilled in the art. In some embodiments, a pair of adjacent top rail channels 129 may extend along the top rear frame rail 128. A pair of adjacent bottom rail channels 133 may extend along the bottom rear frame rail 132. The sliding doors 140 are slidably mounted in the respective top rail channels 129 of the top rear frame rail 128 and the respective bottom rail channels 133 of the bottom rear frame rail 132.

As illustrated in FIGS. 1 and 2, the box top assembly 110 typically rests on the center tabletop panel 143 of the table top assembly 142 generally behind or adjacent to the rack assembly 78 and generally midway between the end frame assemblies 64 of the base frame 3. The box top assembly 110 may be attached to the table top assembly 142 using any suitable technique which is known by those skilled in the art. As illustrated in FIG. 7, in some embodiments, a pair of fasteners 124 may be extended through fastener openings (not numbered) provided in the respective end frame bottom flanges 123 on the end frame bottom 120 of each box top end frame assembly 111. The fasteners 124 are threaded into respective registering fastener openings (not illustrated) provided in the table top assembly 142 of the merchandise pod base 2.

The rack assembly top panel 104 rests on and is attached to the rack assembly 78 and the box top assembly 110. The rack assembly top panel 104 may be attached to the rack assembly 78 and to the box top assembly 110 using any suitable technique which is known by those skilled in the art. In some embodiments, top panel fasteners 92 (FIG. 6) are extended through fastener openings (not numbered) provided in the bracket flanges 90*a* of the outer panel bracket 90 and through a fastener opening (not numbered) provided in the bracket flange 100*a* of the inner panel bracket 100, respectively, and threaded through registering fastener openings (not illustrated) provided in the rack assembly top panel 104 to secure the rack assembly top panel 104 to the rack assembly 78. In like manner, fasteners (not illustrated) may be extended through fastener openings (not numbered) provided in the connecting frame segment flanges 114*a* (FIG. 7) of each box top end frame assembly 111 and threaded through registering fastener openings (not illustrated) provided in the rack assembly top panel 104 to secure the rack assembly top panel 104 to the box top assembly 110.

When the rack assembly top panel 104 is attached to the rack assembly 78 and the box top assembly 110, typically as was heretofore described, a power pole slot 105 (FIGS. 1 and 2) which is provided in the rack assembly top panel 104 registers with the power pole opening 143*a* (FIG. 2) provided in the center tabletop panel 143 of the table top assembly 142. A generally elongated power pole 156 may extend vertically through the power pole opening 143*a* of the table top assembly 142 and the registering power pole slot 105 of the rack assembly top panel 104. The power pole 156 may be fitted with electrical outlets (not illustrated) which provide electrical power support to electronic equipment (not illustrated) supported by the modular merchandise pod 1. The electrical outlets (not illustrated) on the power pole 156 are connected to a suitable source of electrical power (not illustrated). The power pole 156 may be secured to the rack assembly top panel 104 and/or the table top assembly 142 using any suitable technique which is known by those skilled in the art. As illustrated in FIG. 2, in some embodiments, a power pole U-bolt 157 may be attached to the rack assembly top panel 104 or the center tabletop panel 143 of the table top assembly 142 according to the knowledge of those skilled in the art. The power pole U-bolt 157 receives the power pole 156. A power pole bracket 158 is inserted on the power pole U-bolt 157, which receives securing nuts 159 to secure the power pole bracket 158 against the power pole 156.

In typical application, the modular merchandise pod 1 is assembled in a retail outlet (not illustrated) to store, display and/or dispense merchandise (not illustrated). The modular merchandise pod 1 may additionally be used to physically and electronically support electronic equipment such as computers, checkout devices and the like. Accordingly, the center frame assembly 4; the side frame assemblies 20; the front frame assemblies 50; and the end frame assemblies 64 of the base frame 3 of the merchandise pod base 2 are initially fastened to each other to assemble the base frame 3, typically in the manner which was heretofore described. The table top assembly 142 is assembled and attached to the base frame 3 to form the merchandise pod base 2. The rack assembly 78 is assembled and attached to the base frame 3 of the merchandise pod base 2, and the box top assembly 110 is assembled and attached to the table top assembly 142 of the merchandise pod base 2. Finally, the rack assembly top panel 104 is attached to the rack assembly 78 and the box top assembly 110 and the power pole 156 is positioned and secured in place and connected to a source of electrical power (not illustrated).

Merchandise-supporting brackets (not illustrated), which may be conventional and from which merchandise may be suspended, may be attached to the outer hanging rack 86 and/or the center hanging rack 98 of the rack assembly 78 and/or may be attached to one or both of the end frame hanging racks 118 of the box top assembly 110. Merchandise may also be stored out-of-sight between the front frame assemblies 50 of the base frame 3 by sliding the sliding doors 9. Checkout equipment (not illustrated) may be placed on the table top assembly 142, such as on one or each of the side tabletop panels 146 of the table top assembly 142. Electronic equipment can be plugged into the electrical outlets (not illustrated) of the power pole 156 to power the electronic equipment. Additional merchandise and/or equipment can be placed on the rack assembly top panel 104. It will be appreciated by those skilled in the art that the modular construction of the modular merchandise pod 1 facilitates expeditious assembly and installation in retail outlets and can be readily disassembled, as deemed necessary, by reversing the assembly steps which were outlined herein above.

While the illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A modular merchandise pod, comprising:

a generally elongated merchandise pod base having first and second ends;

said merchandise pod base comprising a center frame assembly; a pair of side frame assemblies carried by said center frame assembly; a pair of end frame assemblies carried by said pair of side frame assemblies, respectively; and a pair of front frame assemblies carried by said pair of side frame assemblies, respectively;

each of said pair of side frame assemblies comprising a generally U-shaped side frame, a side frame assembly insert panel provided in said side frame and a bottom frame rail carried by said side frame;

a rack assembly carried by said merchandise pod base and disposed generally midway between said first and second ends;

a rack assembly top panel carried by said rack assembly;

wherein said rack assembly comprises a pair of outer panel assemblies carried by said merchandise pod base and a center panel assembly extending between said pair of outer panel assemblies;

wherein each of said pair of outer panel assemblies comprises an outer panel assembly frame and an outer hanging rack provided in said outer panel assembly frame and said center panel assembly comprises a center panel assembly frame and a center hanging rack provided in said center panel assembly frame; and an outer panel provided in said outer panel assembly frame and a center panel provided in said center panel assembly frame.

2. The modular merchandise pod of claim 1 further comprising a box top assembly carried by said merchandise pod base and wherein said rack assembly top parel is carried by said box top assembly and said rack assembly.

3. The modular merchandise pod of claim 1 wherein said merchandise pod base comprises a generally elongated base frame and a table top assembly carried by said base frame.

4. The modular merchandise pod of claim 3 wherein said table top assembly comprises a generally elongated frame rail and a center tabletop panel and a pair of side tabletop panels carried by said frame rail.

5. The modular merchandise pod of claim 1 further comprising a pair of sliding doors in said center frame assembly of said merchandise pod base.

6. The modular merchandise pod of claim 1 further comprising a power pole slot provided in said rack assembly top panel and a power pole extending through said power pole slot.

7. The modular merchandise pod of claim 1 further comprising a plurality of attachment pin receptacles carried by said merchandise pod base and a plurality of attachment pins carried by said pair of outer panel assemblies of said rack assembly and inserted in said plurality of attachment pin receptacles, respectively.

8. The modular merchandise pod of claim 1 wherein said outer hanging rack and said center hanging rack each comprises a plurality of generally elongated, parallel, spaced-apart rack rods.

9. A modular merchandise pod, comprising:

a generally elongated merchandise pod base having first and second ends;

a rack assembly carried by said merchandise pod base and disposed generally midway between said first and second ends;

a box top assembly carried by said merchandise pod base generally midway between said first and second ends and generally adjacent to said rack assembly;

a rack assembly top panel carried by said rack assembly and said box top assembly;

wherein said merchandise pod base comprises a generally elongated base frame and a table top assembly carried by said base frame;

wherein said merchandise pod base comprises a center frame assembly; a pair of side frame assemblies carried by said center frame assembly; a pair of end frame assemblies carried by said pair of side frame assemblies, respectively; and a pair of front frame assemblies carried by said pair of side frame assemblies, respectively;

wherein said center frame assembly comprises a bottom frame rail; a top frame rail disposed in generally parallel, spaced-apart relationship with respect to said bottom frame rail; and a pair of sliding doors between said bottom frame rail and said top frame rail; and wherein each of said pair of side frame assemblies comprises a generally U-shaped side frame, a side frame assembly insert panel provided in said side frame and a bottom frame rail carried by said side frame.

10. The modular merchandise pod of claim 9 wherein each of said pair of end frame assemblies comprises a generally U-shaped end frame, an end frame insert panel provided in said end frame and an end frame bottom carried by said end frame.

11. The modular merchandise pod of claim 10 wherein each of said pair of front frame assemblies comprises a generally U-shaped front frame, a front frame insert panel provided in said front frame and a bottom frame rail carried by said front frame.

12. A modular merchandise pod, comprising:

a merchandise pod base comprising a generally elongated base frame having first and second ends and a generally elongated, rectangular table top assembly carried by said base frame;

a rack assembly carried by said base frame of said merchandise pod base and disposed generally midway between said first and second ends of said base frame;

wherein said rack assembly comprises a pair of outer panel assemblies carried by said base frame of said merchandise pod base and a center panel assembly disposed between and oriented at an obtuse angle with respect to said pair of outer panel assemblies;

a generally elongated, rectangular box top assembly carried by said table top assembly of said merchandise pod base generally midway between said first and second ends of said base frame and generally adjacent to said rack assembly;

a rack assembly top panel carried by said rack assembly and said box top assembly;

a power pole slot provided in said rack assembly top panel;

a power pole extending through said power pole slot;

wherein said merchandise pod base comprises a center frame assembly; a pair of side frame assemblies carried by said center frame assembly; a pair of end frame assemblies carried by said pair of side frame assemblies, respectively; and a pair of front frame assemblies carried by said pair of side frame assemblies, respectively; and wherein said center frame assembly comprises a bottom frame rail; a top frame rail disposed in generally parallel, spaced-apart relationship with respect to said bottom frame rail; and a pair of sliding doors between said bottom frame rail and said top frame rail; each of said pair of side frame assemblies comprises a generally U-shaped side frame, a side frame assembly insert panel provided in said side frame and a bottom frame rail carried by said side frame; each of said pair of end frame assemblies comprises a generally U-shaped end frame, an end frame insert panel provided in said end frame and an end frame bottom carried by said end frame; and each of said pair of front frame assemblies comprises a generally U-shaped front frame, a front frame insert panel provided in said front frame and a bottom frame rail carried by said front frame.

13. The modular merchandise pod of claim 12 wherein said box top assembly comprises a pair of spaced-apart box top end frame assemblies carried by said table top assembly of said merchandise pod base, a plurality of frame rails connecting said box top end frame assemblies and a pair of sliding doors carried by said plurality of frame rails.

14. The modular merchandise pod of claim 13 wherein each of said box -top end frame assemblies comprises a box top end frame carried by said table top assembly of said merchandise pod base, an end frame hanging rack provided in said box top end frame and an end frame insert panel provided in said box top end frame adjacent to said end frame hanging rack, and wherein said plurality of frame rails is carried by said box top end frame.

* * * * *